US005560167A

United States Patent [19]

Miceli

[11] Patent Number: 5,560,167

[45] Date of Patent: Oct. 1, 1996

[54] LAMINATED MASONRY BLOCK SYSTEM

[76] Inventor: Robert Miceli, 1951 Rockaway Pkwy., Brooklyn, N.Y. 11236-5505

[21] Appl. No.: 248,670

[22] Filed: May 25, 1994

[51] Int. Cl.[6] ..... E04B 1/38

[52] U.S. Cl. ..... 52/285.4; 52/204.2; 52/269; 52/279; 52/309.9; 52/405.4; 52/564; 52/568; 52/713

[58] Field of Search ..... 52/204.1, 204.2, 52/169.14, 269, 270, 275, 276, 279, 284, 285.1, 285.4, 405.1, 405.2, 405.3, 405.4, 300, 309.9, 309.14, 293.2, 564, 568, 566, 585.1, 702, 713, 741.4, 745.05, 745.09, 745.1, 746.1

[56] References Cited

U.S. PATENT DOCUMENTS

| | | | |
|---|---|---|---|
| 927,563 | 7/1909 | Londelius | 52/698 |
| 1,370,160 | 3/1921 | Schenk | 52/204.2 X |
| 1,815,921 | 7/1931 | Lapof . | |
| 1,925,103 | 9/1933 | Loftus et al. . | |
| 2,087,541 | 7/1937 | Koester . | |
| 2,182,470 | 12/1939 | Erdman . | |
| 2,199,112 | 4/1940 | O'Leary . | |
| 2,261,510 | 11/1941 | Atcheson | 52/564 X |
| 2,696,102 | 12/1954 | Zagray | 52/204.2 X |
| 3,861,104 | 1/1975 | Bower | 52/713 X |
| 4,055,928 | 11/1977 | Magerle . | |
| 4,058,948 | 11/1977 | Warren . | |
| 4,091,585 | 5/1978 | Rudichuk | 52/275 X |
| 4,134,241 | 1/1979 | Walton | 52/275 |
| 4,148,166 | 4/1979 | Toone | 52/405.1 X |
| 4,193,241 | 3/1980 | Jensen . | |
| 4,209,568 | 6/1980 | Clem | 52/169.14 X |
| 4,551,959 | 11/1985 | Schmid . | |
| 4,557,094 | 12/1985 | Beliveau . | |
| 4,614,071 | 9/1986 | Sams . | |
| 4,694,624 | 9/1987 | Juhas | 52/270 X |
| 4,720,952 | 1/1988 | Fricker | 52/713 X |

*Primary Examiner*—Wynn E. Wood
*Assistant Examiner*—Kevin D. Wilkens
*Attorney, Agent, or Firm*—Richard C. Litman

[57] ABSTRACT

A system of components for constructing a wall or other portion of a building from insulated masonry blocks, and method steps of using the same. The blocks are sandwiches having outer masonry wall sections surrounding a core of rigid insulating material. External surfaces of the blocks are flush. Top and bottom edges of the masonry sections have holes for accepting ties which join the outer masonry wall sections of each block to one another. Ties may also span adjacent blocks and courses of blocks. Ties are provided in two types. H-shaped ties span both adjacent blocks and adjacent courses. U-shaped ties cooperate with blocks laid on a slab or foundation surface. A joist anchor is provided which enables a joist to be fastened directly to an exterior wall. Variations of configuration of the blocks offer wall pieces, corner pieces, and reinforced lintels. Method steps of constructing a wall include assembling blocks as they are laid, joining of the insulating cores of adjacent blocks by water resistant adhesive, sealing the exterior surface of the wall, and installing joists by employing a novel joist anchor.

15 Claims, 4 Drawing Sheets

LAMINATED MASONRY BLOCK SYSTEM

BACKGROUND OF THE INVENTION

1. Field of the Invention

The present invention relates to modular, insulated masonry blocks.

2. Description of the Prior Art

As building standards have evolved in recent times, insulation has assumed an ever more prominent role. For a long time, masonry construction has been valued for its durability and appearance, and any deficiency in the insulative value thereof has been accepted. Solid masonry walls, such as brick and stone, are dense, but this density passes heat to an extent now unacceptable. Where insulation was required, it was provided by insulation placed inside the wall after the masonry was in place.

Modular masonry units incorporating internal insulation have been developed, and several representative examples are discussed below.

U.S. Pat. No. 2,199,112, issued to Jeremiah J. O'Leary on Apr. 30, 1940, discloses an insulation filled masonry unit including protruding pins for maintaining orientation of the block in a wall assembly while accommodating thermal expansion, and also having internal reinforcing rods. It should be noted that O'Leary's masonry unit has conventional masonry construction including voids, and is not a sandwich wherein masonry walls are separated. Instead, the masonry portion of the block is continuous, and the voids are filled with insulation.

In U.S. Pat. No. 2,182,470, issued to Jay Erdman on Dec. 5, 1939, discloses a three part insulated masonry unit having outside masonry walls sandwiching a layer of insulation. Internal metal ties are provided. All external surfaces of Erdman's masonry unit are flush.

U.S. Pat. No. 1,815,921, issued to Samuel Lapof on Jul. 28, 1931, is directed to a masonry block incorporating a sheet of lead therein for blocking X-rays. Lapof shows adhesion of a material normally associated with insulation to the lead sheet. The invention resides in the masonry blocks, and no cooperating external apparatus is disclosed.

U.S. Pat. No. 1,925,103, issued to Donald A. Loftus et al. on Sep. 5, 1933, describes an insulated building block based around a conventional concrete or like structural block. The block is clad with insulating material at the interior and exterior surfaces. The insulating material spans two flanges formed in the concrete portion of the block, thus rendering those surfaces flush. A brick fascia is then applied to one of the interior or exterior surfaces, and the cores of the concrete block remain open.

A building block shown in U.S. Pat. No. 4,614,071, issued to Carl R. Sams et al. on Sep. 30, 1986, combines features of Erdman '470 and Loftus et al. '103. A sandwich having masonry external walls sandwiching an insulating core has offset slab members, thus defining grooves in one surface and corresponding flanges in an opposed surface, This is provided only in the four external surfaces which will mate with other blocks. This arrangement enables succeeding blocks to interlock with their predecessors as a wall is assembled. The insulating core is not continuous, having cylindrical voids formed therein.

U.S. Pat. No. 4,557,094, issued to Jean L. Beliveau on Dec. 10, 1985, illustrates another block having offset slabs for interlocking. A block suitably adapted for corners is shown. Adjacent blocks are spanned by an elongated angle channel describing an ell in cross-section, thereby unifying a wall built up from Beliveau's blocks.

U.S. Pat. No. 4,058,948, issued to Millard R. Warren on Nov. 22, 1977, discloses a masonry block having a square core. The core has a slab of insulating material disposed longitudinally therein. The slab does not occupy the entire core, and is sandwiched by air-filled voids to the external and internal sides of the slab. The solid portions of the block, i.e., the masonry and insulation portions, leave generally flush external surfaces.

U.S. Pat. No. 4,193,241, issued to Knud Jensen et al. on Mar. 18, 1980, discloses a plug made from insulating material and configured to cooperate with the open core of a masonry block. The plug includes a protruding portion to space successive courses apart, thereby assisting in forming mortar joints therebetween.

U.S. Pat. No. 4,055,928, issued to Otto Magerle on Nov. 1, 1977, discloses a masonry unit comprising front and rear masonry walls enclosing a core made from insulating material. The masonry unit described therein is of the sandwich type, in that the front and rear walls are separated from one another. The core is hollow, there being an air filled void. After building the wall, concrete is poured into these voids to unify the wall.

U.S. Pat. No. 4,551,959, issued to Donald T. Schmidt on Nov. 12, 1985, discloses a sandwich-type insulated masonry block wherein the front and rear walls include projections which interfit so as to cause the insulation filling the space between these walls to define a serpentine path. The external surfaces of the block are flush.

U.S. Pat. No. 2,087,541, issued to Frederick H. Koester on Jul. 20, 1937, discloses a building block which is not of the sandwich-type. The block includes a core made from insulating material and having a skeleton made up from slats. External lateral edges of the block are grooved to receive a cooperating tie-rod which extends along a plurality of blocks. The tie-rod is adhered to each block, and does not penetrate them.

None of the above inventions and patents, taken either singly or in combination, is seen to describe the instant invention as claimed.

SUMMARY OF THE INVENTION

The present invention improves on the basic concept of building with insulated masonry blocks by adding ancillary devices and by joining blocks by ties and adhesive or any suitable method.

The basic blocks are formed as three-part sandwiches, outer structural slab members surrounding a slab of rigid insulating material. Blocks are provided with holes for accepting ties which span adjacent front and rear slab members and courses of blocks. Blocks are provided in three varieties, including general purpose wall pieces; corner pieces; and elongated, reinforced lintels for spanning unsupported distances.

An advantage of slab construction of masonry blocks is that the interior and exterior walls may be dissimilar. Thus, one preferred surface material and texture may be provided to the exterior of the wall, and a different material and texture may be exposed to the interior. An illustrative example is provided by a masonry block having a natural stone exterior and a ceramic interior. In this example, one aesthetically pleasing material, typically employed for exterior surfaces, and an aesthetic ceramic tile interior wall are provided. There is no need to construct the latter in a separate operation. Both aesthetic and insulating properties are imparted to the finished wall.

Ties are of two varieties, including an H-shaped tie which spans both laterally and vertically adjacent blocks, and a U-shaped tie which spans only front and rear slabs of one block. The latter variety is preferably used for constructing a first block course laid on a slab or foundation surface, and for a finish course.

A joist anchor is provided for direct securement of wooden, floor supporting joists to the masonry wall. The joist includes a perforated bar having separate dowels which are inserted into both the perforations of the bar and into the holes formed in the blocks, in the manner of ties. The bar projects to the interior of the building, and suitable fasteners penetrate the holes and are fastened there, thus joining the joist to the bar.

In a preferred method of construction, adjacent insulated masonry blocks are adhered to one another by the following method. Front and rear slabs are conventionally mortared to surrounding corresponding front and rear slabs. Adjacent center insulating slabs are adhered to one another with a water repellant adhesive in addition to being connected by ties. Also, the exterior surface of the wall is sealed. Thus, the finished wall has both an excellent insulation property and weather resistance.

Accordingly, it is a principal object of the invention to provide a cooperating system of insulated, durable, weight bearing structural blocks for constructing building walls.

Another object is to provide structural blocks bearing dissimilar interior and exterior surfaces.

Another object is to provide structural blocks bearing finished, aesthetically pleasing interior and exterior surfaces.

It is another object of the invention to provide ties for connecting the front and rear slabs of each block.

It is a further object of the invention to provide ties spanning adjacent blocks and for joining adjacent courses.

Still another object of the invention is to provide ties spanning adjacent blocks and cooperating with a slab or foundation surface.

A still further object of the invention is to align and quickly install the novel blocks in a wall assembly being constructed therewith.

An additional object of the invention is to provide superior weather, thermal, and moisture resistance to a finished wall.

It is again an object of the invention to provide specialized blocks suitable for corners of walls, windows, and door openings.

Yet another object of the invention is to provide specialized insulated blocks suitable for spanning unsupported distances.

A still further object of the invention is to enable securement of joists directly to load bearing, masonry walls without impairing the structural integrity of the novel blocks.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
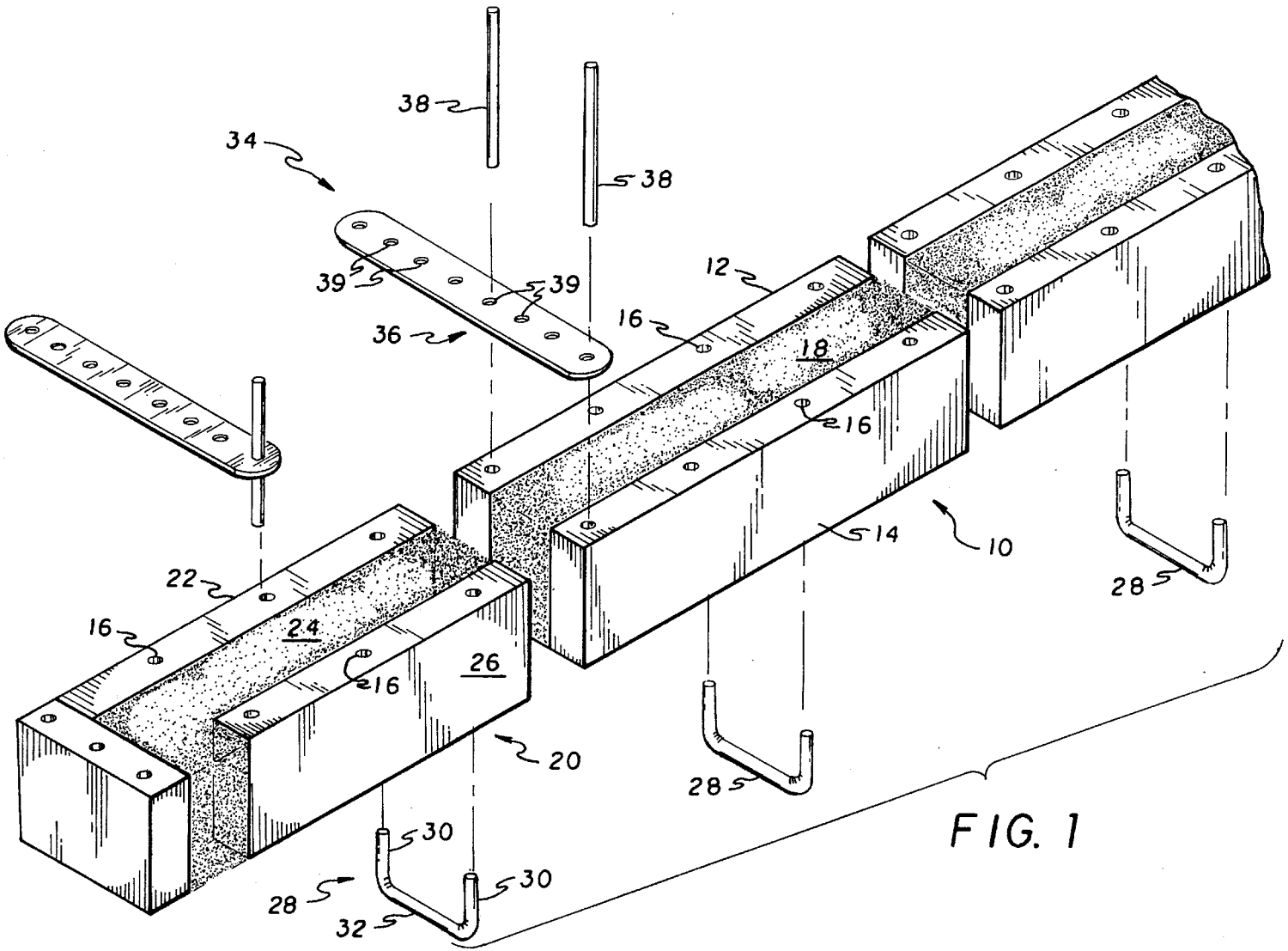
FIG. 1 is an exploded, perspective view of the major building components of the invention.

The basic components of the invention are illustrated in FIG. 1 of the drawings. The most frequently employed type of block, which will be called a wall piece 10, is seen to include inner and outer masonry wall sections 12,14, respectively, having vertical holes 16 formed therein. A solid core 18 of rigid insulation material is suitably adhered during manufacture to wall sections 12,14, as by asphaltic adhesive (not shown) applied to abutting surfaces thereof.

For blocks intended to end a wall, or to form a corner, a corner piece 20 is furnished. Corner piece 20 is generally fabricated in similar fashion to that producing wall piece 10, except that the outer wall section 22 and core 24 of the corner piece are L-shaped. An inner wall section 26 is shorter than the overall length of corner piece 20. Outer wall section 22 may be formed from two joined slabs, as illustrated, or may be formed by a monolithic, L-shaped structure.

The term "masonry", as applied to the material employed in forming the structural, weight bearing portions of the various blocks, will be understood to encompass precast concrete, ceramic, natural stone, and similar solid, non-elastic materials having suitable durability and compressive strength.

Wall and corner pieces 10,20 are unified by either of two types of ties. For the first course of blocks, a U-shaped tie 28 is provided. Tie 28 has two parallel dowels 30 connected by a link 32, which is arranged normal to dowels 30. The first course of blocks is typically laid on a slab or foundation surface (not shown). Link 32 is attached to this surface, and dowels 30 penetrate holes 16 formed in adjacent blocks.

For subsequent courses, an H-shaped tie 34 is provided. The link 36 of tie 34 is arranged normal to and towards the center of dowels 38, there being two dowels 38 facing upwardly and two dowels 38 facing downwardly. Dowels 38 penetrate two respective holes 16 of inner and outer masonry wall sections 12 and 14.

Preferably, tie 34 is not made up from uniting link 36 and dowels 38, as by welding. Rather, these components interfit and are maintained temporarily in place within bores 39 by friction. After completion of the wall, they will be secured by weight of the wall, mortar applied to joints, and by interfitting of all associated components.

Dowels 38 of ties 34 also penetrate holes 16 of upper and lower blocks 10 or 20 that are vertically stacked. Thus, blocks 10 and 20 are aligned with adjacent overlying blocks 10 and 20.

A tie 28 or 34 typically connects a right-side hole 16 of one block 10 or 20 to the left-side hole 16 of a neighboring block 10 or 20. Dowels 30 or 38 cooperate with holes 16. Dowels 30 and 38 are dimensioned and configured to penetrate into holes 16 so as to fit snugly thereinto. There is preferably little slackness or play between a dowel 30 or 38 and the walls of a hole 16, but the fit will not be so snug as to resist insertion. Dowel 30 or 38 is preferably short enough to penetrate to the point that link 32 or 36 comes to lie flush against the outer surface of the blocks 10 or 20 connected by tie 28 or 34.

Of course, other connecting arrangements of ties are possible. For example, if a wall is constructed having a double thickness, then the interior courses could be joined to the exterior courses, as well as joining adjacent blocks of one course. Ties having an appropriate link length may be provided to satisfy this construction.

Figure 2:
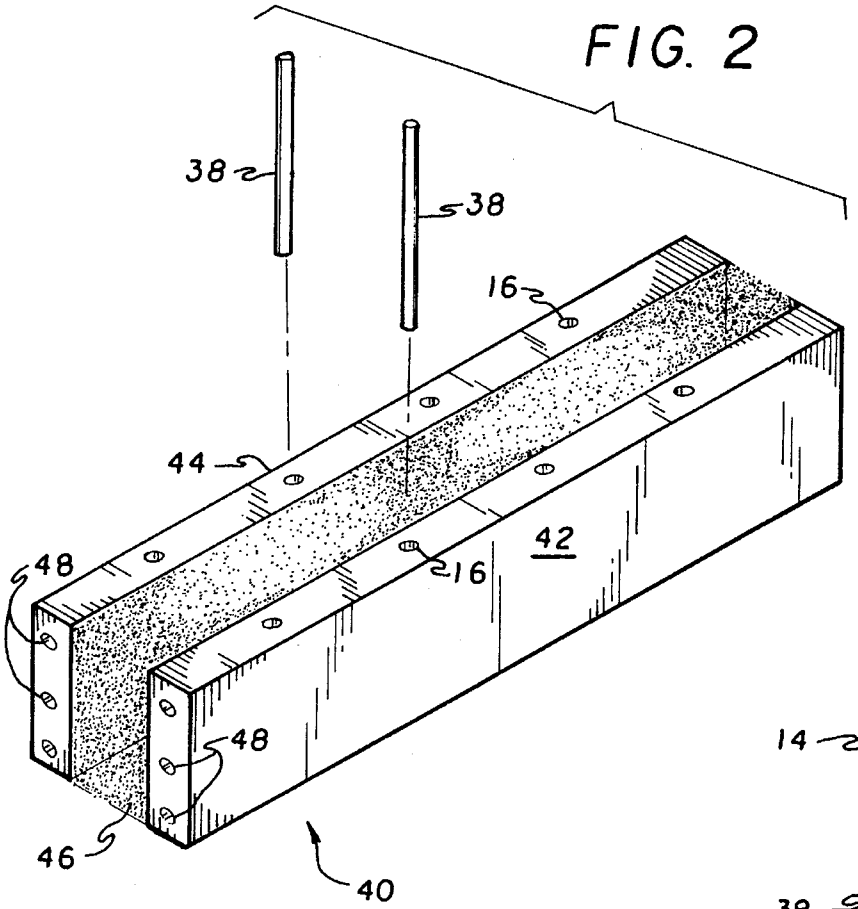
FIG. 2 is an exploded, perspective view of a novel lintel.

For spanning spaces unsupported from below, as over window openings (not shown), a lintel 40 is provided, and is shown in FIG. 2. Lintel 40 has inner and outer wall sections 42 and 44, a solid core 46 of insulation material, and reinforcing bars 48 extending horizontally through wall sections 42 and 44. Concrete or ceramic structural members are inherently limited as to tensile strength, and reinforcing bars 48 improve the ability of a lintel 40 to support succeeding courses of blocks. Lintel 40 also includes holes 16 to enable alignment of blocks 10 or 20 of these succeeding courses.

A lintel 40 is set in place so that right and left portions rest on blocks, such as two corner pieces 20, and are adhered in place, as will be discussed hereinafter.

Figure 3:
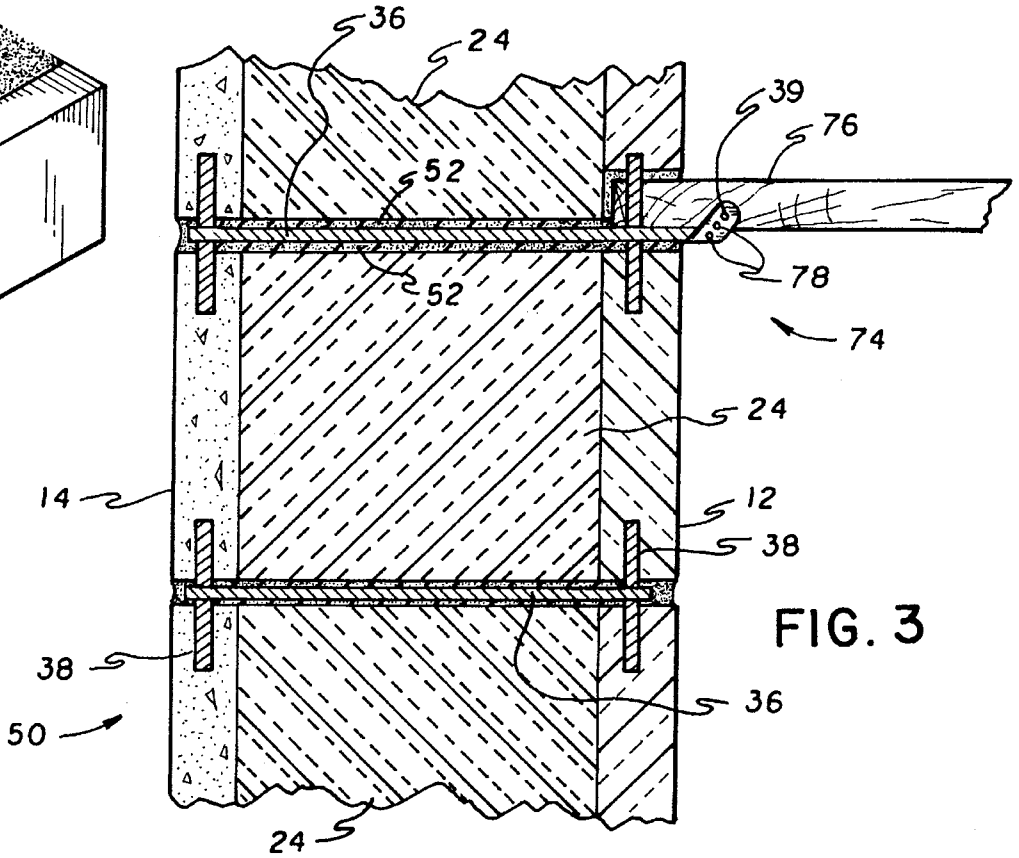
FIG. 3 is an environmental, side elevational, cross sectional detail view of a completed wall incorporating the novel components, drawn to enlarged scale.

Generally, a wall is constructed from the novel blocks in any suitable manner. A representative wall 50 is shown in FIG. 3. However, in place of the usual mortar joints, it is preferred that blocks be joined as follows. That portion of a joint lying between overlying inner masonry wall sections and between overlying outer masonry wall sections comprises mortar, according to conventional practice. Overlying insulating cores 24 are joined by a suitable adhesive, such as asphaltic adhesive 52 (see FIG. 3) rather than by mortar. As employed herein, the term "asphaltic adhesive" will refer to a homogeneous material, such as tar, not comprising a mixture of solids bound by a cementitious material. Synthetic and other natural adhesives will also be encompassed by the term.

Figure 4:
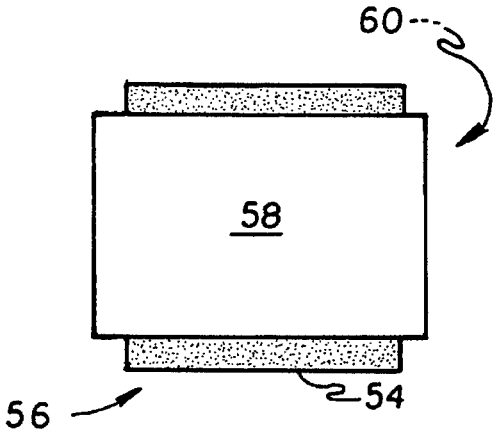
FIGS. 4 and 5 are side and end elevational views, respectively, of an alternative embodiment of each of the two principal types of block, drawn to reduced scale.
Figure 5:
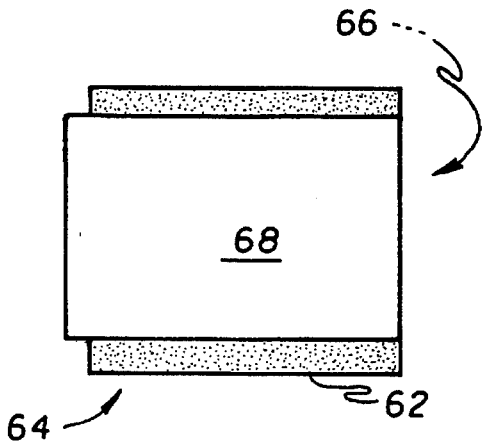

A second embodiment of block is illustrated in FIGS. 4 and 5. It will be recalled from FIG. 1 that wall pieces 10 and corner pieces 20 have flush external or outer surfaces, due to wall sections 12,14 and cores 18 or 24 being coextensive. In the first alternative embodiment, it will be seen that the core 54 of an alternative embodiment wall piece 56 extends beyond inner and outer wall sections 58,60. Similarly, core 62 of a second alternative embodiment corner piece 64 extends beyond inner and outer wall sections 66,68.

An alternative embodiment core 54 or 62 thus is placed in more intimate contact with another core 54 or 62 than occurs in the case of cores 18 and 24, shown in FIG. 1. Resistance of a finished wall 50 to air and water permeability is thus enhanced.

Figure 6:
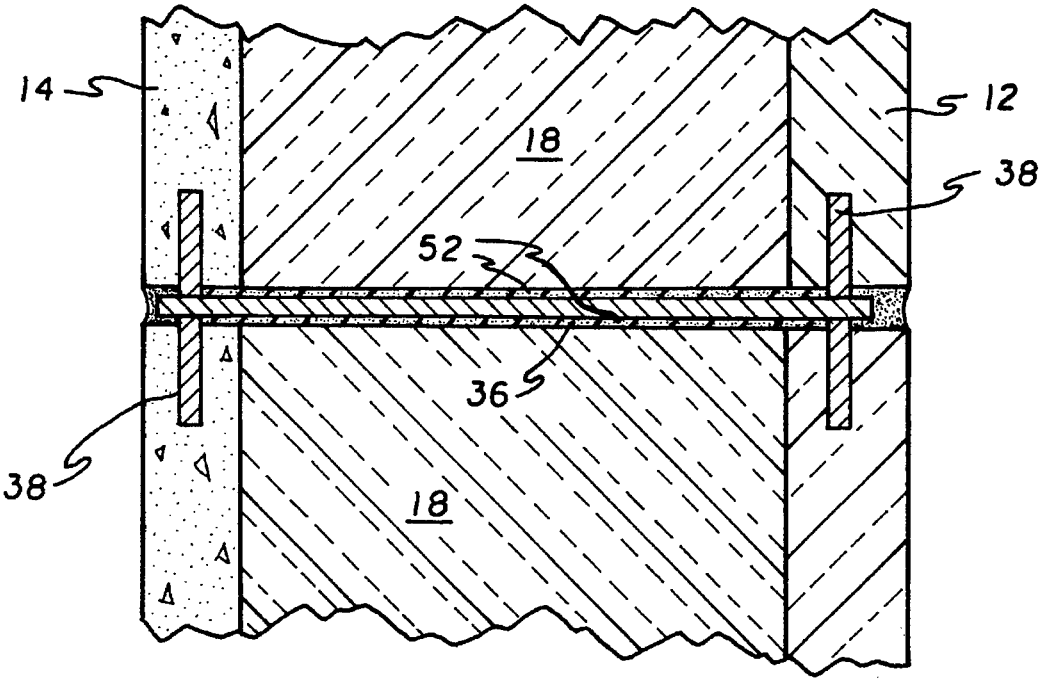
FIG. 6 is a side elevational, cross-sectional detail view of a completed wall incorporating alternative embodiment components, drawn to enlarged scale.

Joints of asphaltic adhesive 52 shown in FIG. 3 are preferably of uniform thickness. Of course, part of the joint is occupied by link 36, as seen in FIGS. 3 and 6.

Again referring to FIG. 3, a joist anchor 74 is provided for attaching a joist 76 directly to completed wall 50. Joist anchor 74 may comprise link 36 and dowel 38, with link 36 arranged to project beyond wall 50, extending to the interior of the building. A link 36 of greater than usual length may be employed for this purpose. Link 36 is bent or twisted, so that a portion of it will come to lie flush against the side of joist 76, as shown.

Returning to FIG. 3, a fastener, such as a bolt 78, is illustrated, and fastens joist 76 to joist anchor 74. The plurality of bores 39 enable several bolts 78 to be installed, where desired.

FIG. 3 also illustrates the versatility of sandwich construction of blocks 10,20, wherein inner and outer wall sections 12,14 are manufactured from different material. It will be appreciated that the novel system of components provides materials for building a wall 50, superior insulation and weather resistance, and differing, aesthetically pleasing surface materials in one construction operation.

Figure 7:
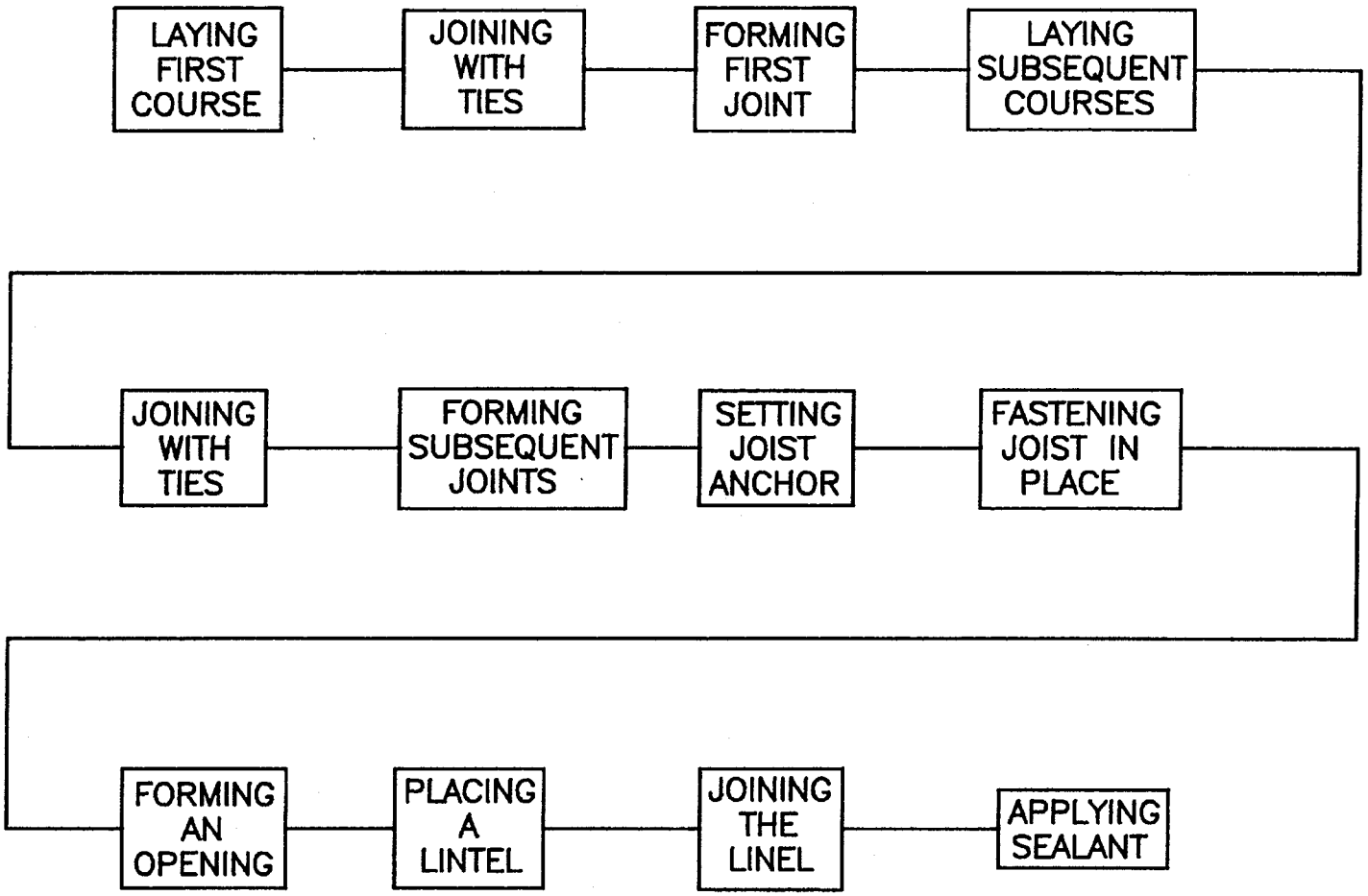
FIG. 7 is a block diagram summarizing construction steps utilizing the novel components.

Steps for building a wall according to the present invention are summarized in FIG. 7, reading from the top left. The method is set forth in greater detail as follows, reference numerals referring to FIGS. 1–6. A first course of block is laid upon a foundation (not shown) or other suitable surface. Preferably, corner pieces 20 are employed at corners and exposed ends of a wall, such as door jams. Ties 28 unify blocks 10 or 20 of the first course.

The first joint is formed, applying conventional mortar between corresponding inner and outer masonry wall sections 12,14. The wall is extended upwardly by laying subsequent courses. Ties 34 joint vertically or laterally adjacent blocks 10 or 20 of succeeding courses. The steps of unifying the blocks by joining inner and outer wall sections with ties, and forming subsequent joints are repeated, until the wall reaches a desired height.

At appropriate courses, joist anchors 74 are set in place. Inner wall sections 12 are cut to receive a joist 76, which is then set in place. Joist 76 occupies the space created by cutting out inner wall section 12, and is fastened in place by bolts 78 or other suitable fasteners.

Where window openings are desired, an opening in the wall is formed. A lintel 40 is placed over the opening. Lintel 40 is wider than the opening, ends thereof resting on blocks 20. The lintel is joined by forming a mortar joint below lintel 40, on the portion of blocks 20 bearing the weight of lintel 40. Also, ties 34 join lintel 40 to succeeding block courses built thereabove.

A final step in completing the wall includes applying a water resistant sealant to the exterior surface thereof.

It is to be understood that the present invention is not limited to the sole embodiment described above, but encompasses any and all embodiments within the scope of the following claims.

I claim:

1. A building construction system of components for constructing insulated masonry buildings comprising:

a plurality of insulated masonry blocks having parallel wall sections selected from the group consisting of concrete, ceramic, natural stone, and mixtures thereof, each said block comprising a first inner masonry wall section and a first outer masonry wall section, means defining a plurality of vertical holes located within said parallel first inner and outer masonry wall sections, and a core of rigid foam insulation material adhered to said parallel wall sections;

a plurality of U-shaped ties, each having at least two dowels cooperating with said vertical holes, and each tie having a link member arranged normal to and connecting said dowels;

a plurality of H-shaped ties, each tie having at least two upwardly facing dowel portions integral with at least two downwardly facing dowel portions arranged selectively in a series of bores by friction fit in a link member arranged normal to said dowel portions, said upwardly facing dowel portions and said downwardly facing dowel portions cooperating with said vertical holes, said link member extending beyond placement of said dowel portions, whereby a subsequent course of blocks is formed on said first course; and asphaltic adhesive for joining said first course with subsequent courses.

2. The system of components according to claim 1, further comprising at least one lintel having:

a second inner masonry wall section containing at least one horizontally disposed reinforcement bar;

a second outer masonry wall section containing at least one horizontally disposed reinforcement bar; and a second core of rigid foam insulation material.

3. The system of components according to claim 1, wherein said blocks include at least one corner piece wherein said first outer wall section and said core are L-shaped.

4. The system of components according to claim 1, further comprising at least one joist anchor comprising a flat bar having top and bottom principal surfaces, means defining a succession of fastener holes formed along said flat bar, and at least one upper dowel and at least one lower dowel fixed thereto, said upper and lower dowels arranged normal to said principal surfaces and dimensioned and configured to cooperate with said vertical holes provided in said insulated masonry blocks.

5. The system of components according to claim 1, said first inner wall sections and said outer wall sections having outer edges, wherein said cores of said blocks extend beyond said outer edges.

6. The system of components according to claim 1, said first inner wall sections and said outer wall sections having outer edges, said outer edges being coplanar, whereby said blocks have flush outer surfaces.

7. The system of components according to claim 1, wherein the asphaltic adhesive comprises tar.

8. A building construction system of components for constructing insulated masonry buildings comprising:

a plurality of insulated masonry blocks having parallel wall sections selected from the group consisting of concrete, ceramic, natural stone, and mixtures thereof, each said block comprising a first inner masonry wall section and a first outer masonry wall section, means defining a plurality of vertical holes located within said parallel inner and outer masonry wall sections, and a first core of rigid foam insulation material adhered to said parallel wall sections; at least one corner piece wherein said first outer masonry wall and said first core being L-shaped;

at least one lintel having a second inner masonry wall section containing at least one horizontally disposed reinforcement bar, a second parallel outer wall masonry wall section containing at least one horizontally disposed reinforcement bar, and a second core of rigid foam insulation material adhered to said parallel wall sections;

a plurality of H-shaped ties, each having at least two upwardly facing dowel portions integral with at least two downwardly facing dowel portions cooperating with said vertical holes, and a link member arranged normal to and connecting said dowel portions which are arranged selectively in a series of bores in said link member by friction fitting;

at least one joist anchor comprising a flat bar having top and bottom principal surfaces, a succession of fastener holes formed along said flat bar, and at least two dowels, each consisting of an upper dowel portion and a lower dowel portion, removably disposed within at least two of said fastener holes, said dowels arranged normal to said principal surfaces and dimensioned to cooperate with said vertical holes provided in said insulated masonry blocks; and asphaltic adhesive for joining said masonry blocks and at least one lintel in the construction of insulated masonry buildings.

9. The system of components according to claim 8, wherein said first inner wall sections and said outer wall sections have outer edges, said cores of said blocks extending beyond said outer edges.

10. The system of components according to claim 8, said first inner wall sections and said outer wall sections having outer edges, said outer edges and said first cores being coplanar, whereby said blocks have flush outer surfaces.

11. The system of components according to claim 8, wherein the asphaltic adhesive comprises tar.

12. A method of building a wall from masonry blocks comprising:

each masonry block having parallel inner and outer masonry wall sections selected from the group consisting of concrete, ceramic, natural stone, and mixtures thereof, vertical holes formed in the inner and outer masonry wall sections, an insulating foam core, and multiple ties having dowels dimensioned and configured to cooperate with the vertical holes;

laying a first course of said masonry blocks on a suitable surface and joining inner and outer masonry wall sections of each block to one another with U-shaped ties;

joining the insulating foam cores of adjacent blocks with asphaltic adhesive; and laying subsequent courses of blocks on the first course of blocks by joining with H-shaped ties and applying asphaltic adhesive, whereby a unitary wall is formed.

13. The method of claim 12, further comprising the steps of:

setting at least one flat bar joist anchor in the wall, wherein each joist anchor has two integral friction fitting dowels, each dowel consisting of an upwardly facing dowel portion, a downwardly facing dowel portion, and a laterally projecting member having multiple holes therein to fasten to the joist;

attaching a joist to the anchor by passing fasteners through the joist and through the multiple holes in the laterally projecting member of the joist anchor; and fastening the joist and joist anchor.

14. The method of claim 12, further comprising the steps of:

forming an opening in a wall being built; and placing a lintel formed from a material selected from the group consisting of concrete, ceramic and natural stone on the top of the highest course defining right and left boundaries of the opening.

15. The method of claim 12, further comprising the step of: applying a water-resistant sealant to the exterior surface of a wall built by said method.

* * * * *